US006662079B2

(12) United States Patent
Bodie

(10) Patent No.: US 6,662,079 B2
(45) Date of Patent: Dec. 9, 2003

(54) METHOD AND SYSTEM FOR PREPARATION OF MAILPIECES HAVING A CAPABILITY FOR PROCESSING INTERMIXED QUALIFIED AND NON-QUALIFIED MAILPIECES

(75) Inventor: Kevin W. Bodie, Bethel, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/201,386

(22) Filed: Nov. 30, 1998

(65) Prior Publication Data

US 2003/0033053 A1 Feb. 13, 2003

(51) Int. Cl.[7] ..... G07R 7/00

(52) U.S. Cl. ..... 700/227; 700/221; 700/226; 700/225

(58) Field of Search ..... 700/221, 227, 700/225, 226; 705/410, 408, 406

(56) References Cited

U.S. PATENT DOCUMENTS

| | | | | | |
|---|---|---|---|---|---|
| 4,800,505 | A | * | 1/1989 | Axelrod et al. | 364/478 |
| 4,817,042 | A | * | 3/1989 | Pintsov | 364/478 |
| 5,321,604 | A | * | 6/1994 | Peach et al. | 364/401 |
| 5,419,440 | A | * | 5/1995 | Picoult | 209/583 |
| 5,429,249 | A | * | 7/1995 | Belec et al. | 209/584 |
| 5,475,603 | A | * | 12/1995 | Korowotny | 364/478 |
| 5,600,565 | A | * | 2/1997 | Wagner et al. | 364/478.07 |
| 5,612,889 | A | * | 3/1997 | Pintsov et al. | 364/478.14 |
| 5,659,481 | A | * | 8/1997 | Qutub et al. | 364/478.08 |
| 5,777,883 | A | * | 7/1998 | Lau et al. | 364/478.08 |
| 5,799,302 | A | * | 8/1998 | Johnson et al. | 707/7 |
| 5,818,724 | A | * | 10/1998 | Brewster, Jr. et al. | 364/478.08 |
| 5,841,658 | A | * | 11/1998 | Bouchard | 364/464.16 |
| 5,873,073 | A | * | 2/1999 | Bresnan et al. | 705/410 |
| 5,918,220 | A | * | 6/1999 | Sansone et al. | 705/408 |
| 5,930,796 | A | * | 7/1999 | Pierce et al. | 707/100 |
| 6,002,095 | A | * | 12/1999 | Bodie et al. | 209/584 |
| 6,119,051 | A | * | 9/2000 | Anderson, Jr. et al. | 700/221 |

* cited by examiner

*Primary Examiner*—Donald P. Walsh
*Assistant Examiner*—Michael E. Butler
(74) *Attorney, Agent, or Firm*—Angelo N. Chaclas; Charles R. Malandra, Jr.; Michael J. Cummings

(57) ABSTRACT

A method and system for processing intermixed qualified and non-qualified mailpieces and the like. Control documents are produced by a data processing system and transported to an inserter system. The inserter system inputs the control documents and assembles mailpieces in accordance with a data base of mailpiece records identified by coded information on the documents. When the system is configured for a mailing, nominally specified operations can be modified in accordance with specified conditions comprising Boolean combinations of tests of mailpiece record fields. In one embodiment intermixed qualified and non-qualified mail can be separated.

20 Claims, 3 Drawing Sheets

METHOD AND SYSTEM FOR PREPARATION OF MAILPIECES HAVING A CAPABILITY FOR PROCESSING INTERMIXED QUALIFIED AND NON-QUALIFIED MAILPIECES

BACKGROUND OF THE INVENTION

This invention relates to the preparation of large mailings and the like. More particularly it relates to systems and apparatus for the preparation of documents and the assembly of multiple mailpieces including such documents.

The term "mailpieces" as used herein means items intended to be delivered by a postal service or private courier service. Typically preparation of mailpieces includes, but is not limited to, printing or otherwise providing documents including variable information pertaining to addressees of the mailpieces and the assembly of such documents with other elements of the mailpiece. The term "assembly" as used herein means the execution of actions to incorporate the documents into mailpieces. Typically, such actions can include: accumulating documents with other materials such as preprinted inserts, folding and inserting the resulting accumulations into envelopes, printing addresses and other information on the outside of the envelopes, and franking the mailpiece with an appropriate postage amount.

Inserter systems for the preparation of mailpieces are well known. Such systems receive documents which have been preprinted, typically by a data processing system, accumulate documents associated with particular mailpieces, add inserts to the accumulation, and insert the accumulation into an envelope. Known inserter systems can also print the mailpiece envelope with an address as well as other information and can frank the mailpiece with a postal indicia for the appropriate amount of postage. Such systems operate at high speeds, on the order of thousands of mailpieces per hour, and with low error rates, and are essential for production of modern mass mailings.

While systems such as those described above have proven highly successful, certain disadvantages remain. Modem inserter systems operate at extremely high processing rates which require that documents, inserts and envelopes all be moved and handled at high speeds. In such systems it is difficult to identify mailpieces which require special handling. In particular it has proven difficult to intermix qualified and non-qualified mail in a single mailing job. ("Qualified" mail is mail which qualifies for special discounted postal rates because it has been pre-sorted and processed in accordance with strict postal service requirements.) It is desirable to intermix qualified and non-qualified mail pieces since, for example, constraints in the mail generation software may make it necessary or desirable to merge two mailing lists where one list is qualified and the other is not. However it is critical that such a mailing not be delivered to the Postal Service with qualified and non-qualified mail intermixed since the Postal Service will reject such mail.

Another, related problem is the occasional need to make modifications to the material printed on particular mailpieces within a job. For example a "Postnet" barcode should not be printed on a non-qualified mail piece; or a user may find that certain messages or slogans are not well received in certain cities and/or states. Heretofore mail for such places would have to be handled as a special job. Such a special job would of course be a source of delay, and would also increase the likelyhood of misprocessed mailpieces.

Thus it is an object of the subject invention to provide a system and method for the preparation and assembly of mailpieces which has increased flexibility for handling of intermixed mailpieces and of mailpieces which require modification of what is to be printed on the mailpiece envelope.

BRIEF SUMMARY OF THE INVENTION

The above object is achieved and the disadvantages of the prior art are overcome in accordance with the subject invention by means of a method and apparatus for method for processing of a mailing by a mail preparation system, where an inserter system or the like assembles said mailpieces, the inserter system including a programmable controller programmed to control assembly of the mailpieces in accordance with information included in a mailpiece record, such assembly including causing at least one print field to be printed on an envelope for said mailpiece. The system stores a predetermined Boolean combination of predetermined tests of at least one field of the mailpiece records. The programmable controller controls the inserter system to assemble said mailpieces in accordance with the information in the mailpiece record and, for each of the mailpieces, prior to printing the print field, determines if said Boolean combination is satisfied; and if it is not satisfied, diverts the mailpiece.

In accordance with one aspect of the subject invention, a plurality of said fields of said mailpiece records are tested.

In accordance with another aspect of the subject invention, printing of said print field is modified if said Boolean combination is not satisfied.

In accordance with another aspect of the subject invention, said print field is suppressed if said Boolean combination is not satisfied.

In accordance with another aspect of the subject invention, a predetermined string of alphanumeric characters is appended to said print field if said Boolean combination is not satisfied.

In accordance with another aspect of the subject invention, the diverted mailpiece is processed as non-qualified mail.

In accordance with another aspect of the subject invention, the print field includes a barcode representation of address information.

In accordance with still another aspect of the subject invention an inserter system or the like assembles said mailpieces, the inserter system including a programmable controller programmed to control assembly of the mailpieces in accordance with information included in a mailpiece record, such assembly including causing at least one print field to be printed on an envelope for said mailpiece. The system stores a predetermined Boolean combination of predetermined tests of a plurality of fields of the mailpiece records. The programmable controller controls the inserter system to assemble said mailpieces in accordance with the information in the mailpiece record and, for each of the mailpieces, prior to printing the print field, determines if the Boolean combination is satisfied; and if it is not satisfied, modifies further processing of the mailpiece.

In accordance with another aspect of the subject invention, processing of the mailpiece is modified by modifying the print field.

In accordance with another aspect of the subject invention, processing of the mailpiece is modified by suppressing the print field.

In accordance with another aspect of the subject invention, processing of the mailpiece is modified by appending a predetermined string of alphanumeric characters to the print field.

Other objects and advantages of the subject invention will be apparent to those skilled in the art from consideration of the detailed description set forth below and the attached drawings.

DETAILED DESCRIPTION OF PREFERRED EMBODIMENTS OF THE SUBJECT INVENTION

Figure 1:
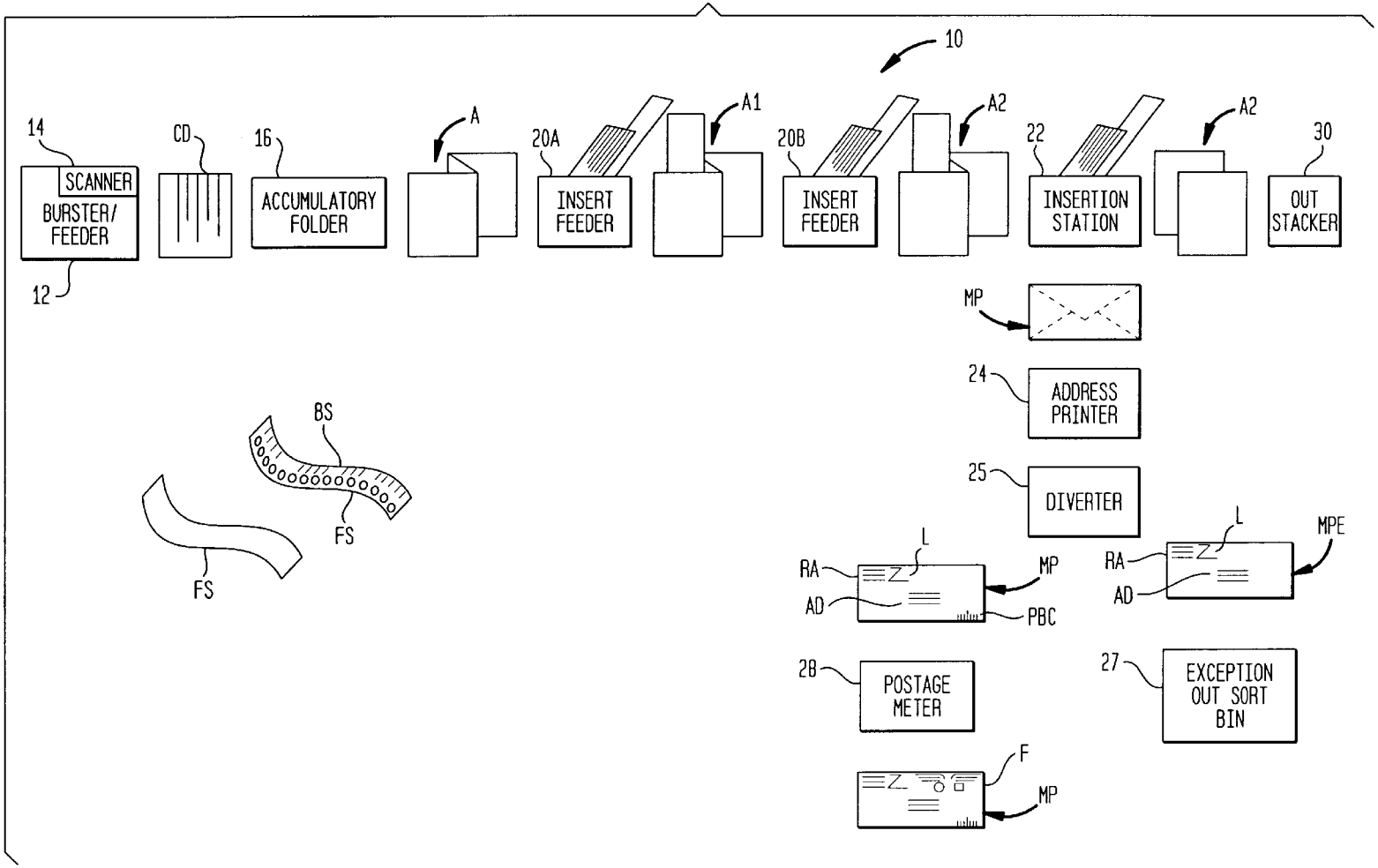
FIG. 1 shows a schematic block diagram of an inserter system suitable for use in accordance with the subject invention.

An inserter system suitable for use in accordance with the subject invention is shown in FIG. 1. Inserter system 10 includes burster/feeder 12 which inputs preprinted documents in fanfold form, separates the documents and removes and discards sprocket feed strips FS from the edges of the document. Each group of documents for a particular mailpiece includes at least control document CD. On control documents CD strips FS are marked with code BC which is read by scanner 14 before strips FS are removed. In simpler systems code BC can be a "dash code" of the type known for use in directly controlling inserter systems. In newer, more complex systems code BC can be a conventional bar code which serves as a pointer to a mailpiece record which record contains information for controlling the inserter; as will be more fully described below. In other known inserter systems, a cut sheet document feeder can be used in place of burster/feeder 12 and documents can be in cut sheet form .

Control document CD, and any additional associated pages P are fed from burster feeder 12 to accumulator 16 where documents for each mailpiece are formed into separate accumulations A and folded.

Accumulation A is then fed to insert stations 20A and 20B where preprinted inserts I are added to form accumulations A1 and A2. Those skilled in the art will of course recognize that the number of such insert stations used will vary from application to application.

Accumulation A2 is then fed to insertion station 22 where it is inserted into an envelope and sealed to form mailpiece MP.

Mailpiece MP is then fed to address printer 24 which prints address AD on the outside of the envelope. Depending on the size of the print field of printer 24, printer 24 also can be used to print other information such as a variable return address (or other text message) RA, logo L, and postal barcode PBC (a barcode including address information such as an address zip code) on the envelope. (Those skilled in the art will recognize that dash codes as described above typically cannot include sufficient information to define even address AD so that systems incorporating dash codes typically use window envelopes to provide addressing information.)

The above described mailpiece assembly operations are well known and need not be described further here for an understanding of the subject invention.

In accordance with the subject invention, after a mailpiece is printed it can be diverted as an exception by conventional diverted 25 to exception outsort bin 27 based upon testing of selected fields of the mailpiece record, as will be described further below. In a preferred embodiment of the subject invention exceptions MPE can be non-qualified mailpieces which are intermixed with qualified mailpieces. Preferably, postal barcode PBC will be suppressed on exceptions MPE.

Undiverted mailpiece MP is then franked with postal indicia F in an appropriate amount by postage meter 28 in a conventional manner.

System 10 also includes outstacker 30 for diverting mailpieces when an error is detected prior to printing of an address.

As noted above, inserter systems wherein said code BC is a barcode which is used as a pointer to a mailpiece record (i.e. an electronic record associated with a mailpiece to be assembled) are known. By incorporating data for controlling assembly of mailpieces in mailpiece records an essentially unlimited amount of data can be associated with each mailpiece. Thus addresses, return addresses, logos, and postal bar codes can all readily specified in addition to specification of the number of inserts to be added at each insert feeder, postage amounts, etc. Systems incorporating such mailpiece records are described in commonly assigned U.S. Pat. No. 4,800,505; to: Axelrod et al.; for: "MAIL PREPARATION SYSTEM"; issued Jan. 24, 1989, which is hereby incorporated by reference. Embodiments of the system of U.S. Pat. No. 4,800,505 are marketed by the assignee of the present application under the name "Direct Connection", described in *The Direct Connection*, version 1.30.

A typical mail piece record (hereinafter sometimes MRDF record) which is associated with a mailpiece to be processed is shown in Table 1 below.

TABLE I

| MRDF Record | | |
|---|---|---|
| Start | Length | Description |
| 1–60 | 60 | Full Name |
| 61–120 | 60 | Address 1 |
| 121–180 | 60 | Address 2 |
| 181–240 | 60 | Address 3 |
| 241–300 | 60 | Street (Primary) |
| 301–328 | 28 | City |
| 329–344 | 15 | State |
| 345–349 | 5 | Zip 5 |
| 350–353 | 4 | Zip + 4 |
| 354–355 | 2 | Zip + 2 |
| 356–360 | 10 | Carrier Route |
| 361–362 | 2 | Presort Type (EC/CC/P/R) |
| 363–372 | 10 | Sequence # (Piece ID) |
| 373–379 | 7 | Job ID |
| 380 | 1 | Break 1 Flag (Y/N) |
| 381–382 | 2 | Outsort (Bin #) |
| 383 | 1 | Sealer (Y/N) |
| Total Length | 383 | |

In the record shown in Table 1, bytes 1–60 specify the addressee's name; bytes 61–240 specify 3 lines of additional addressee information such as additional addressees, titles, etc.; bytes 241–344 specify the address; bytes 345–355 specify the Zip Code with either a two or four digit extension; bytes 356–360 specify a carrier route; bytes 361–362 identify the type of presorting which has been carried out for the mailing; bytes 363–372 specify the mailpiece ID, which increases or decreases by one, monotonically for each mailpiece; bytes 373–379 specify the job or mailing in process, and with the mailpiece ID uniquely identify the mailpiece; byte 380 flags a break in the mailing; bytes 381–382 specify an outsort bin so as to identify a particular bin as exception outsort bin 27 or to control further sorting down stream (not shown); and byte 383 specifies whether or not the mailpiece is to be sealed. (Though not shown in FIG. 1, sealers are conventional in inserter systems.)

Other information which can be included in MRDF records can be information such as messages or return addresses or specification of the number of inserts to be added at each insert station. In general the information and format of MRDF records is limited only by the system capabilities.

Figure 2:
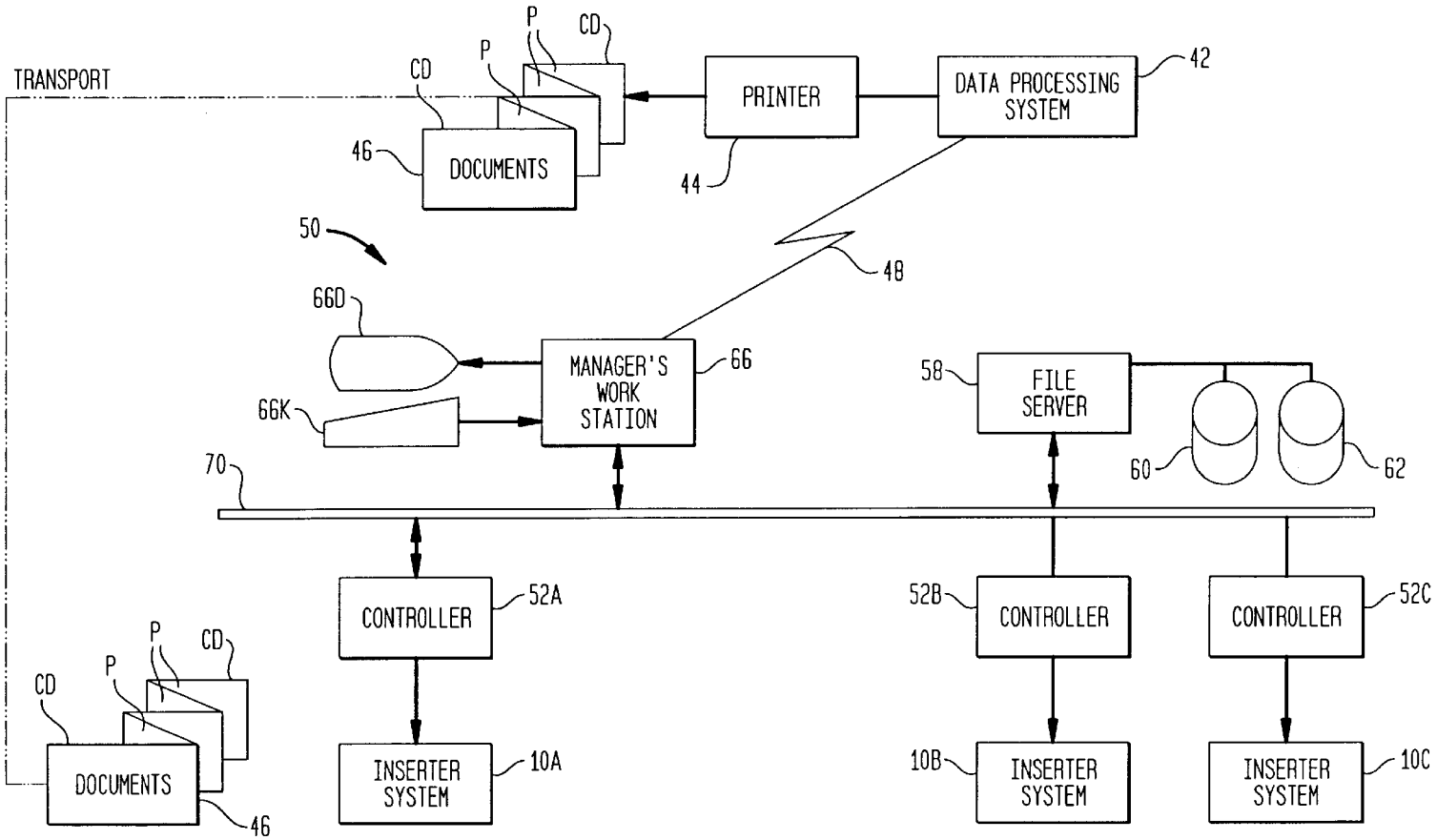
FIG. 2 shows a schematic block diagram of a system for preparing mailpieces.

FIG. 2 shows mail preparation system 40 which includes data processing system 42 and mailpiece assembly system 50.

Data processing system 42 is programmed in a conventional manner to generate documents 46, which include control documents CD and associated documents P; with one control document CD and its associated documents P being associated with each mailpiece, wherein control documents CD are marked with barcode pointers to mailpiece records in the manner described above. In the embodiment shown, system 42 controls printer 44 to print documents 46 directly and documents 46 are transported physically for assembly; however, any convenient method of output ant transport, such as electronic output and transmission for remote printing, can be used and is within the contemplation of the subject invention.

Data processing system 42 also generates and outputs a mailing control file, (hereinafter sometimes mail run data file, or MRDF) which includes a plurality of mailpiece records, in a conventional manner. The mailpiece records each include a plurality of fields containing data for controlling assembly of the mailpiece. The mailing control file is communicated to mailpiece assembly system 50 through communications link 48, which can utilize any convenient form of communication, such as electronic data communication or the physical transfer of media without departing from the scope the subject invention.

In the embodiment shown in FIG. 2, mailpiece assembly system 50 includes inserter systems 10A, 10B, and 10C, which are substantially similar to conventional inserter system 10 described above with reference to FIG. 1, of the type wherein control documents CD include a barcode pointer to a mailpiece record.

Mailpiece assembly system 50 also includes controllers 52A, 52B, and 52C for controlling operation of inserter systems 10A, 10B, and 10C in a manner which will be described more fully below.

Mailpiece assembly system also includes file server 58 which manages MRDF data store 60 which stores mailing control files downloaded from data processing system 42, and which also communicates appropriate mailing control files to controllers 52A, B or C as mailings are assigned to inserter systems, as will be more fully described below. Server 58 also controls data store 62 which stores configuration information such as logos to be printed on mailpiecs, print fonts to be used and other common information used generally in the production of a mailing job. In accordance with the subject invention, data store 62 also stores conditions, or tests, on fields of the mailpiece record which condition assembly of the mailpiece, as will be further described below (Data stores 60 and 62 are preferably stored on a common storage device but are shown separately for ease of illustration. In general such data stores can be maintained on any device or system which is conveniently accessible without departing from the scope of the subject invention.)

Mailpiece assembly system also includes manager's workstation 66, which includes display 66D and keyboard 66K through which a site manager can access and edit data stores 60 and 62 and can assign mailings to various inserter systems.

Communications among workstation 66, file server 58 and controllers 52A, B and C is preferably carried out over conventional local area network 70 in a manner well understood by those skilled in the art and which need not be discussed further for an understanding of the subject invention.

Figure 3:
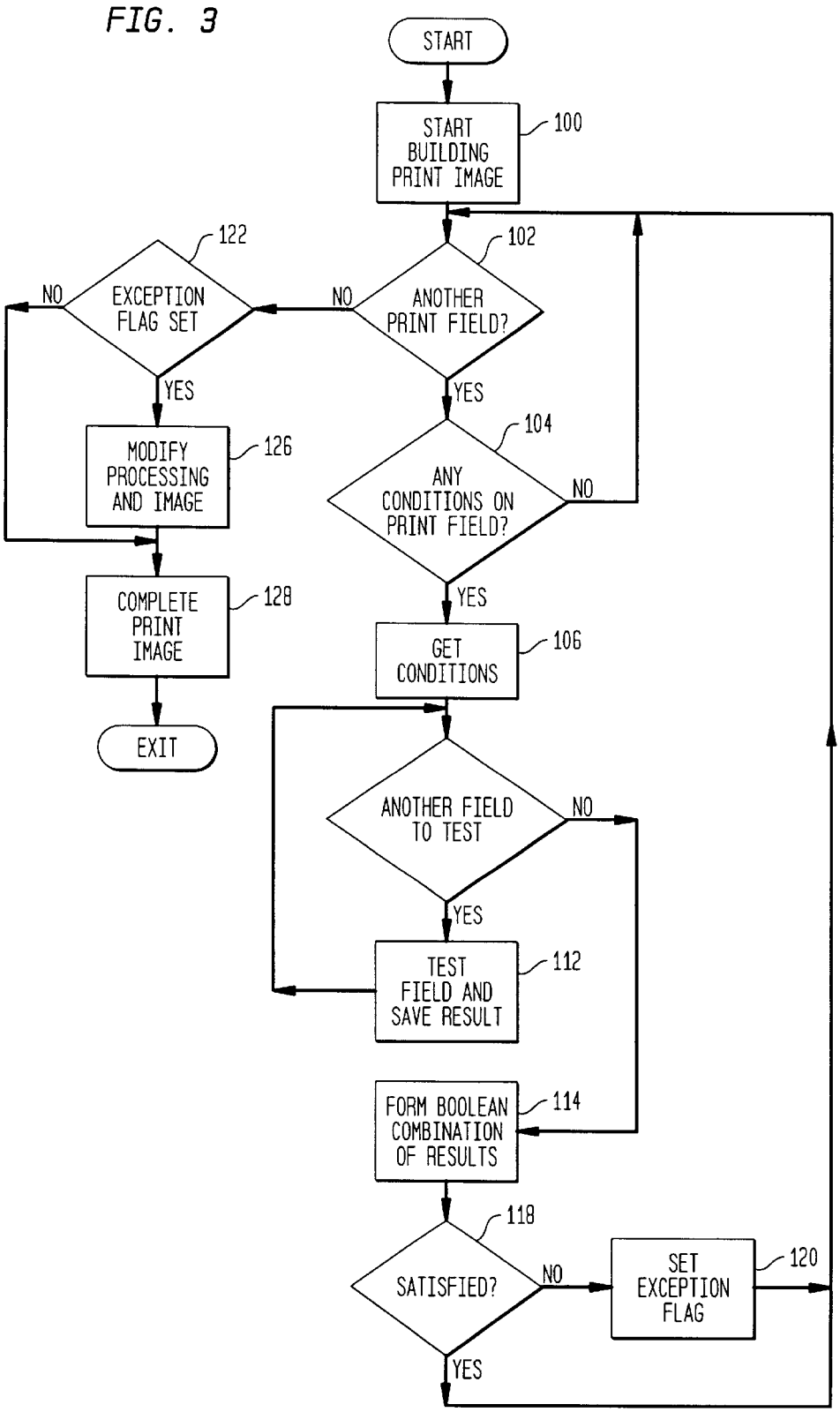
FIG. 3 shows a flow diagram of the operation of the system of FIG. 2.

Turning to FIG. 3, a high level flow diagram of the operation of mail preparation system 40 in accordance with the method of the subject invention is shown.

Initially, as described above with respect to FIG. 2, data processing system 42 generates document sets 46 for a mailing. Each of sets 46 corresponds to a particular mailpiece and includes a control document CD and any associated pages P. Each of control documents CD includes coded information which is used by one of controllers 52A, 52B, or 52C to control corresponding inserter system 10A, 10B, or 10C (hereinafter assumed to be controller 52A and system 10A) to assemble the corresponding mailpiece. At 102 the document sets are transported to inserter system 10A. In the embodiment shown, documents are printed locally by printer 44 and physically transported to system 10A, but in other preferred embodiments the documents can be generated in any convenient manner such as on portable magnetic media, or by electronic transmission for remote printing.

Data processing system 42 also downloads an MRDF to data store 60 through file server 58. As described above the MRDF comprises mailpiece records defining assembly of each mailpiece MP in the mailing, as is well known in the art, and control documents CD include barcode pointers identifying corresponding records in a similarly well known manner.

(While in the embodiment shown in FIG. 3A only a single mailing is described, for clarity of description, those skilled in the art will recognize that in many embodiments multiple mailings can be in process at one time.)

When document sets 46 reach inserter system 10A documents 46 are input in sequence, mailpiece identification numbers are read at, and the MRDF in data store 60 is accessed to read the corresponding mailpiece record. System 10A then processes mailpiece MP through insertion of documents 46, together with any specified inserts I, into envelope E in accordance with the mailpiece record, as described above. Such initial assembly operations are well known to those skilled in the mailing art and need not be discussed further for an understanding of the subject invention. Such initial assembly operations are described in above mentioned U.S. Pat. No. : 4,800,505 and commonly assigned, co-pending U.S. patent application Ser. No.: 09/134977; for: "METHOD AND SYSTEM FOR REGENERATION OF MISPROCESSED MAILPIECES OR THE LIKE"; filed: Aug. 14, 1998; by: Bodie (E-765) which are hereby incorporated by reference.

(Those skilled in the art will recognize that inserter systems as shown in FIG. 1 comprise a series of stations through which partially completed mailpieces MP progress in sequence as they are processed. Thus, though operations of inserter 10A are shown with respect to a single mailpiece MP for simplicity and clarity of description, those skilled in the art will recognize that controller 52A is programmed to concurrently control assembly of all of mailpieces MP being processed by system 10A at any one time.)

At 100 system 10A begins to build a print image to be printed on envelope E of mailpiece MP in a conventional manner and as specified during the initial configuration of system 10A for the mailing. The print image comprises fixed print fields which are defined during initial configuration and are printed on all mailpieces MP (unless suppressed, as will be described further below), and variable print fields whose content is defined by the mailpiece record for each of mailpieces MP.

Initial configurations can be specified in any convenient manner without departing from the scope of the subject invention. In one embodiment initial configuration information is specifically coded and input for a mailing. In another embodiment various configurations are stored in a data base and accessed in accordance with pointers in the MRDF. Such data bases are described in commonly assigned, co-pending U.S. patent application Ser. No.: 09/124501; for: "SYSTEM, METHOD AND APPARATUS FOR PREPARATION MAILPIECES"; filed: Jul. 29, 1998; by: Hart (E-750).

At 102 controller 52A tests to determine if there are any more print fields to be processed. If there are, at 104 it determines if there are any conditions on the print field and, if not, returns to 102. Otherwise, at 106 conditions for the active print field are accessed.

Conditions on various print fields are specified during initial configuration for a mailing, as described above. Such conditions specify particular Boolean combinations of particular tests of the contents of selected fields in the mailpiece record and actions to be taken if the Boolean conditions are not satisfied.

In a preferred embodiment of the subject invention conditions on a "Postnet" print field are used to distinguish non-qualified mail which is intermixed with qualified mail. This field contains a "Postnet" barcode representation of the Zip code for a mailpiece as specified in the mailpiece record. Qualified mail includes mail which has been appropriately presorted and printed with a "Postnet" barcode specifying an extended seven or nine digit Zip code. Mailpiece records for qualified mail will have a string "EC", "CC", or "R" in the Presort Type field and will have non-zero values for either the Zip+2 field or the Zip+4 field. An example of a condition on the "Postnet" field which will cause non-qualified mail to be outsorted and will suppress printing of the Postnet barcode is:

```
FOR (Postnet)                                          print field
    IF (Presort Type = "EC" or "CC" or "R")            test 1st mailpiece record field
        AND ((Zip + 2 not = 0) OR (Zip + 4 not = 0))   test 2d mailpiece & 3rd record
                                                       fields/form Boolean
                                                       combination/test combination
    THEN (Print Postnet)                               mailpiece qualified
    ELSE (Suppress Postnet, Divert)                    mailpiece non-qualified
```

(The above example is illustrative and is not intended to represent actual requirements of the USPS.)

It will be readily apparent that conditions as described above can encompass all Boolean combinations of tests on the contents of specified mailpiece record fields, including string matches and arithmetic tests.

Also it should be noted that the subject invention is not limited to embodiments where exceptions are diverted. For example assume that the Springfield Massachusetts Little League team defeated The Springfield Illinois team to win the Little League World Series and that the mailer wishes to print congratulations on the mailpiece envelopes. Such a message might be misunderstood outside Massachusetts and resented in Springfield, Ill. Printing of a "Message" print field might be conditioned as follows:

```
FOR: (Message)
    IF (City = "Springfield")
        AND (State = "Massachusetts" or "Mass" or "MA")
    THEN (Print "CONGRATULATIONS TO OUR SPRINGFIELD
            CUSTOMERS ON YOUR VICTORY")
    ELSE (Suppress Message)
```

It will be apparent from the above example that conditions on multiple mailpiece record fields allow a precession of control of mailpiece assembly unavailable in the prior art.

(A "Direct Connections" production mail system having a capability to suppress printing of a print field based on the content of a singe MRDF field has been marketed by the assignee of the present application more than one year prior to the filing date of the present application. However the capabilities of this system were limited in that only single field could be tested; thus the marketed system could not distinguish between Springfield Mass. and Springfield Ill. Further, the marketed system could not handle intermixed qualified and non-qualified mail.)

Returning to FIG. 3, at 110 controller 52A determines if there is another mailpiece record field test specified in conditions on the current print field. If there is, at 112 the specified test is conducted and the results are saved and the system returns to 110. When all fields specified have been tested, at 114 the specified Boolean combination of results is formed and tested at 118. If the combination is not satisfied the appropriate exception flag is set and the system returns to 102. If the combination is satisfied the system returns to 102 directly.

(It will be apparent to those skilled in the art that the choice of which mailpieces MP are classified as exceptions MPE is arbitrary; depending on whether a particular Boolean combination or its negation is specified.)

When all print fields have been examined for specified conditions, the system goes to 122 to determine if any exception flags have been set. If any exception flags are set, at 126 further processing is modified (e.g. by setting diverted 25 to divert exception MPE to bin 27) and the print image is modified (e.g. by suppressing the corresponding print field or by substituting or appending different strings in the print field) as specified in the conditions. Then at 128 the print image is completed and the system exits to complete processing in a conventional manner which need not be described further here for an understanding of the subject invention.

If no exception flags are set the system goes directly to 128.

The embodiments described above and illustrated in the attached drawings have been given by way of example and illustration only. From the teachings of the present application those skilled in the art will readily recognize numerous other embodiments in accordance with the subject invention. Accordingly, limitations on the subject invention are to be found only in the claims set forth below.

What is claimed is:

1. A method for processing of a mailing having qualified and non-qualified mailpieces by a mail preparation system, said method comprising the steps of:

a) providing means for assembling said mailpieces, said assembling means including a programmable controller programmed to control assembly of said mailpieces in accordance with information included in a mailpiece record, said assembly including causing at least one print field to be printed on an envelope for said mailpiece;

b) storing a predetermined Boolean combination of predetermined tests of at least one field of said mailpiece records, said tests distinguishing qualified and non-qualified mailpieces;

c) said programmable controller controlling said means for assembling to assemble said mailpieces in accordance with said information and, for each of said mailpieces, prior to printing said print field, determining if said Boolean combination is satisfied; and d) if said Boolean combination is not satisfied, intervening in the mailpiece assembly controlled by the mailpiece record and diverting said mailpiece distinct from the information controlled assembly.

2. A method as described in claim 1 wherein a plurality of said fields of said mailpiece records are tested.

3. A method as described in claim 1 wherein printing of said print field is modified if said Boolean combination is not satisfied.

4. A method as described in claim 3 wherein said print field is suppressed.

5. A method as described in claim 3 wherein a predetermined string of alphanumeric characters is appended to said print field.

6. A method as described in claim 1 wherein said diverted mailpiece is processed as non-qualified mail.

7. A method as described in claim 1 wherein said print field includes a barcode representation of address information.

8. A method as described in claim 7 wherein said print field is suppressed.

9. A method for processing of a mailing having qualified and non-qualified mailpieces by a mail preparation system, said method comprising the steps of:

a) providing means for assembling said mailpieces, said assembling means including a programmable controller programmed to control assembly of said mailpieces in accordance with information included in a mailpiece record, said assembly including causing at least one print field to be printed on an envelope for said mailpiece;

b) storing a predetermined Boolean combination of predetermined tests of a plurality of fields of said mailpiece records, said tests distinguishing qualified and non-qualified mailpieces;

c) said programmable controller controlling said means for assembling to assemble said mailpieces in accordance with said information and, for each of said mailpieces, prior to printing said print field, determining if said Boolean combination is satisfied; and d) if said Boolean combination is not satisfied, intervening in the mailpiece assembly controlled by the mailpiece record and modifying further processing of said mailpiece distinct from the information controlled assembly.

10. A method as described in claim 9 wherein said print field is modified.

11. A method as described in claim 10 wherein said print field is suppressed.

12. A method as described in claim 11 wherein a predetermined string of alphanumeric characters is appended to said print field.

13. A mail preparation system for processing qualified and non-qualified mailpieces, the system comprising:

a) means for assembling said mailpieces, said assembling means including a programmable controller programmed to control assembly of said mailpieces in accordance with information included in a mailpiece record, said assembly including causing at least one print field to be printed on an envelope for said mailpiece;

b) a data store storing a predetermined Boolean combination of predetermined tests of at least one field of said mailpiece records, said tests distinguishing qualified and non-qualified mailpieces;

c) a diverter for changing the path of said mailpieces;

d) said programmable controller being programmed to:

d1) control said means for assembling to assemble said mailpieces in accordance with said information;

d2) for each of said mailpieces, prior to printing said print field, determine if said Boolean combination is satisfied; and d3) if said Boolean combination is not satisfied, intervene in the mailpiece assembly controlled by the mailpiece record and divert said mailpiece distinct from the information controlled assembly.

14. A mail preparation system as described in claim 13 wherein said programmable controller is further programmed to modify said print field if said Boolean combination is not satisfied.

15. A mail preparation system as described in claim 14 wherein said print field is suppressed.

16. A mail preparation system as described in claim 14 wherein a predetermined string of alphanumeric characters is appended to said print field.

17. A mail preparation system as described in claim 13 wherein said Boolean combination is selected to identify non-qualified mail.

18. A mail preparation system for processing qualified and non-qualified mailpieces, the system comprising:

a) means for assembling said mailpieces, said assembling means including a programmable controller programmed to control assembly of said mailpieces in accordance with information included in a mailpiece record, said assembly including causing at least one print field to be printed on an envelope for said mailpiece;

b) a data store storing a predetermined Boolean combination of predetermined tests of a plurality of fields of said mailpiece records, said tests distinguishing qualified and non-qualified mailpieces;

c) said programmable controller being programmed to:

c1) control said means for assembling to assemble said mailpieces in accordance with said information;

c2) for each of said mailpieces, prior to printing said print field, determine if said Boolean combination is satisfied; and c3) if said Boolean combination is not satisfied, intervene in the mailpiece assembly controlled by the mailpiece record and modify further processing of said mailpiece distinct from the information controlled assembly.

19. A mail preparation system as described in claim 18 wherein said print field is modified.

20. A mail preparation system as described in claim 18 wherein said print field is suppressed.

* * * * *